US005253869A

United States Patent [19]

Dingle et al.

[11] Patent Number: 5,253,869

[45] Date of Patent: Oct. 19, 1993

[54] GOLF PUTTER

[76] Inventors: Craig B. Dingle, 58 Hillside Rd.; William Harpell, 30 Springbrook Terr., both of Sparta, N.J. 07871

[21] Appl. No.: 799,276

[22] Filed: Nov. 27, 1991

[51] Int. Cl.[5] ..... A63B 53/02; A63B 53/08

[52] U.S. Cl. ..... 273/80.1; 273/171; 273/194 B; 273/80.2

[58] Field of Search ..... 273/167-175, 273/77 R, 79, 193 R, 194 R, 194 B, 183 D, 80 A, 80.1, 80.2; 403/83, 84; 15/143 R, 144 R, 176.1, 176.4, 176.5, 176.6

[56] References Cited

U.S. PATENT DOCUMENTS

| | | | |
|---|---|---|---|
| 1,657,972 | 1/1928 | Rowe | 273/79 |
| 2,155,830 | 4/1939 | Howard | 273/79 |
| 2,222,534 | 11/1940 | Harris | 273/79 |
| 2,715,026 | 8/1955 | Cadman | 273/171 |
| 2,932,515 | 4/1960 | May | 273/171 |
| 3,143,349 | 8/1964 | MacIntyre | 273/171 |
| 3,817,534 | 6/1974 | Carlino | 273/168 |
| 3,999,765 | 12/1976 | Bishop | 273/171 X |
| 4,325,553 | 4/1982 | Taylor | 273/167 F |
| 4,423,874 | 1/1984 | Stuff | 273/171 |
| 4,519,612 | 5/1985 | Tsao | 273/163 R |
| 4,529,204 | 7/1985 | Yamakawa | 273/193 R |
| 4,540,178 | 9/1985 | Johnson et al. | 273/169 |
| 4,655,459 | 4/1987 | antonious | 273/171 |
| 4,695,054 | 9/1987 | Tunstall | 273/171 |
| 4,754,977 | 7/1988 | Sahm | 273/171 |
| 4,872,684 | 10/1989 | Dippel | 273/164 |
| 4,895,371 | 1/1990 | Bushner | 273/164 |

FOREIGN PATENT DOCUMENTS

| | | | |
|---|---|---|---|
| 1222263 | 5/1987 | Canada | 273/80.1 |
| 9006157 | 6/1990 | European Pat. Off. | 273/80.1 |

*Primary Examiner*—V. Millin
*Assistant Examiner*—Sebastiano Passaniti
*Attorney, Agent, or Firm*—Mathews, Woodbridge & Collins

[57] ABSTRACT

A golf putter with an adjustable head having screw-threaded projections to which weighted metal disks or washers may be added or subtracted to change the center of gravity of the head and thus, the energy and the angular direction through which the ball travels when impacted by the player. An additional feature comprises provisions for changing the angle of attachment of the shaft to the head.

2 Claims, 3 Drawing Sheets

GOLF PUTTER

This relates to techniques and devices for improving the structure and performance of golf clubs, more particularly, putters.

BACKGROUND OF THE INVENTION

According to the article on "Golf", page 506, ENCYCLOPEDIA BRITANNICA 1954 Edition:

> The putt, once the ball is on the green, is perhaps the most delicate shot in golf. The player must hit the ball along a line that allows for very little margin of error, and with enough force to roll the ball to the hole but not too far beyond, in case the hole is missed, to make the return putt difficult. And since most greens are not level, but have numerous minor pitches and slopes, great care must be taken to select the proper line, which may be quite far to one side or the other of the cup.

In the prior art, various techniques have been used to design putters for unproved performance. Most of these involve inserting weights or screws into bores in the putter head in positions that may be adjustable with tools, prior to play.

It is a principal object of the invention to provide techniques and apparatus for adjusting the structure and performance of putter heads to conform to individual requirements. A more particular object is to provide a putter head which may be simply adjusted on the playing course without the use of complicated tools.

These and other objects are achieved in accordance with the present invention in a putter combination in which the core of the head is equipped with one or more projecting screw-threaded posts which are adapted to receive a plurality of donut-shaped washers which function to change or distribute the center of gravity of the putter head in accordance with a desired pattern.

In a preferred embodiment, the core of the putter head is a flat body, say , □ inch thick having parallel inner and outer surfaces, say, 3½ inches long and ½ inch wide, the body being rounded at the corners giving the device a substantially eliptical shape in the principal plane.

In the present embodiment, there are three screw-threaded posts projecting from the inner head surface. The central post is, say, 1¾ inches high, and the two additional posts, say, 1⅜ inches high, which are centered near the two ends of the core face. In the present embodiment, interposed onto each of the posts through their central bores are, say, three annular washers, say, 15/16 inch in diameter each having a central bore ¼ inch in diameter. A nut, ½ inch in diameter, having a hex head holds the disks in place on the respective posts.

Another feature of the present invention is that the position of the shaft is rotatable in the principal plane of the head. An annular cylindrical hub, say, ½ inch thick and ¾ inch in diameter, is interposed onto the base of the central post. The hub has a ¼ inch bore in its lateral wall for accommodating and securing the end of the shaft. The hub is designed to rotate from heel to toe to set a desired angle for the shaft in the principal plane of the head. A particular advantage is that the hub may be removed and reversed to change the club from a right-handed putter to a left-handed putter. The putter head can be rotated through 180 degrees to change the angle of the striking surface.

The center of gravity of the head may be changed in any manner desired by the player by changing the number and position of the annular washers interposed onto the screw-threaded posts. The system may be further varied by having the screw-threaded posts protrude from the outer lateral face instead of the top inner face of the core body .

Another advantage of the present invention is that the weights and hub are visible to the player on the course, so that he has ready access to them for manual redistribution at any time.

Other objects, features and advantages of the invention will be apparent from a study of the attached drawings with reference to the detailed description hereinafter.

SHORT DESCRIPTION OF THE DRAWINGS

DETAILED DESCRIPTION OF THE INVENTION

The putter of the present invention comprises a steel shaft 2, which in the present embodiment may be, for example, two feet, 11 inches long, being tapered in diameter from, say, 1 inch at the upper end to ⅝ inch at the lower end, the terminal quarter inch being screw-threaded, and soldered or otherwise secured in normal relation to the curved side of the cylindrical hub 7 through the lateral bore **7*b*. The annular cylindrical hub 7 is 15/16 inch in outer diameter, ½ inch thick, and has a central bore 7*a*, ¼ inch in diameter, as well as lateral bore 7*b***, and weighs, say, one ounce.

The upper end of the shaft in the present embodiment is encased for an axial length of, say, 10¾ inches, with a gripping sleeve **2*a*** of elastomer, such as hard rubber or neoprene, the surface of which is engraved with a pattern to provide a roughened hand grip.

Figure 1A:
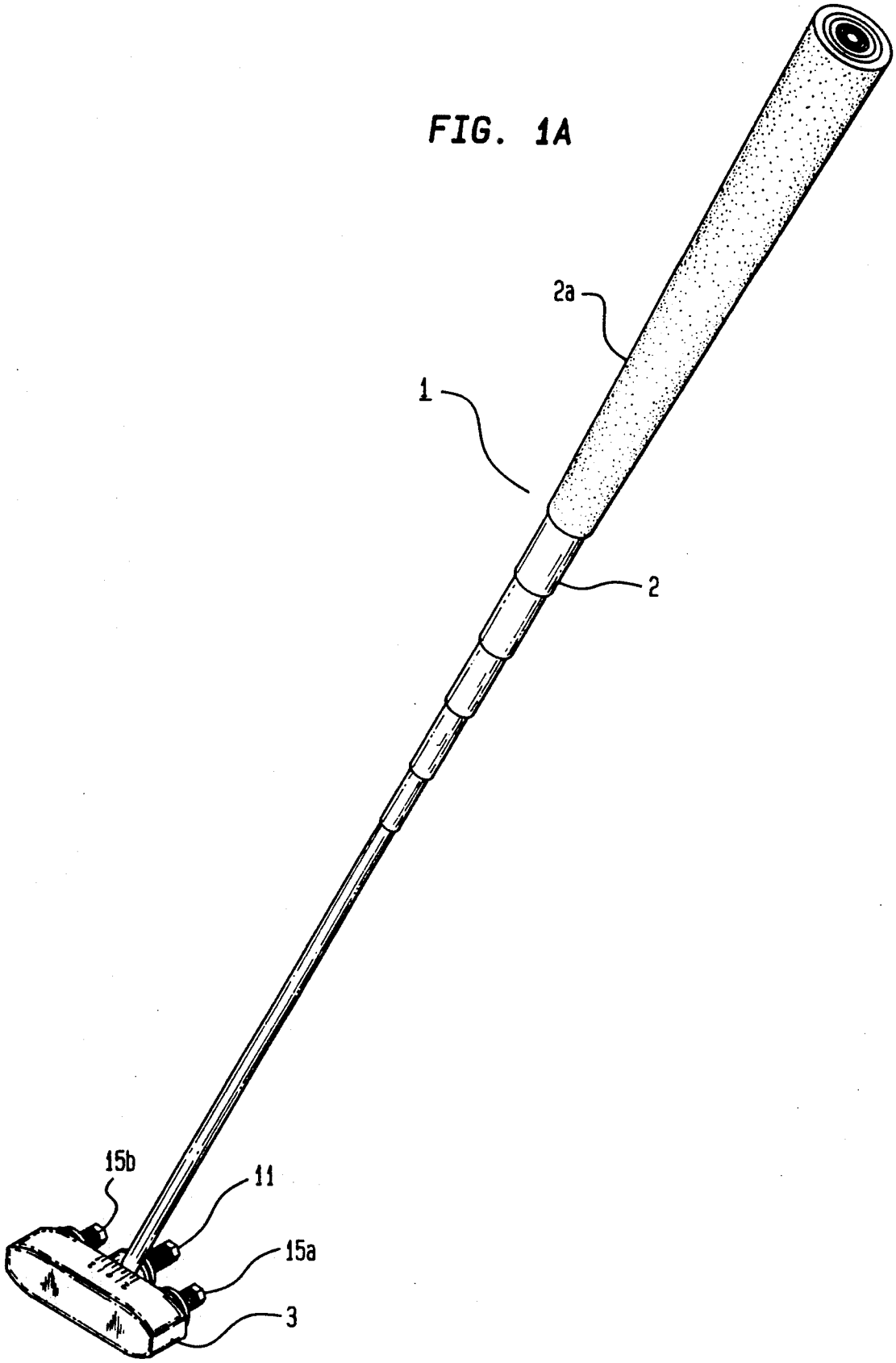
FIG. 1A is a perspective showing of a golf putter including shaft and head, in accordance with the present invention.
Figure 1B:
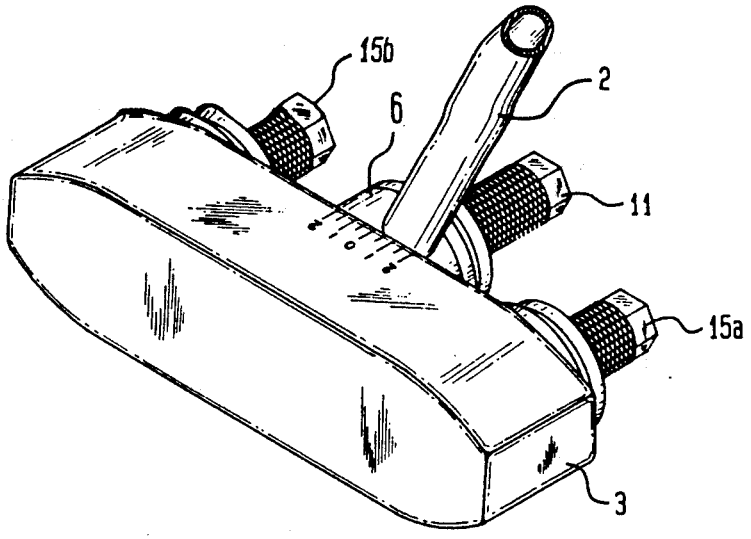
FIG. 1B is a detailed showing of the putter head of FIG. 1A .

FIG. 1B is an enlarged showing from the outer end showing the ball-contacting surface, of the putter head 3, which in the present embodiment is formed of a core of stainless steel, 3½ inches in overall length, 1 inch in overall width, and 9/8 inch thick, with the inner and outer surfaces substantially flat and parallel, and the ends partially rounded, so as to provide a generally eliptical shape in the principal plane of the club head.

Three stainless steel screw-threaded posts **4*a*, 5 and 4*b* (not shown, but identical to 4*a*), each ¼ inch in diameter, project normally from the inner surface of the body 3. The lateral posts 4*a* and 4*b*, each of which is centered ½ inch in from a respective end of body 3, each extend $1\frac{1}{8}$ inch out from the surface. The post 5 extends out about $1\frac{1}{2}$ inches normally from the center of the inner surface of body 3**.

The hub 7, secured to the base of shaft 2, is interposed onto the post 5 through the central bore 7*a*, so that it seats flat against the inner surface of the body 3. Thus, the position of the shaft 2 may be rotated relative to the principal plane of the body 3, and fixed in any desired orientation thereto, as will be explained hereinafter.

Figure 2:
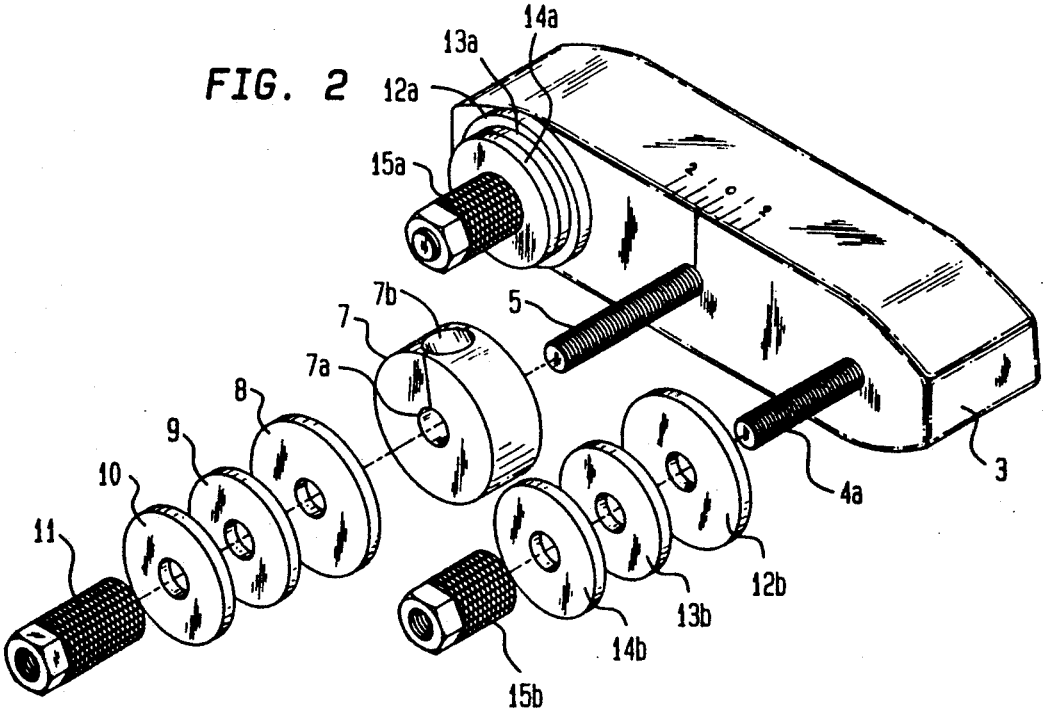
FIG. 2 is an exploded view of the putter head of FIGS. 1A and 1B with the weighted washers in the process of being assembled on the head.
Figure 3:
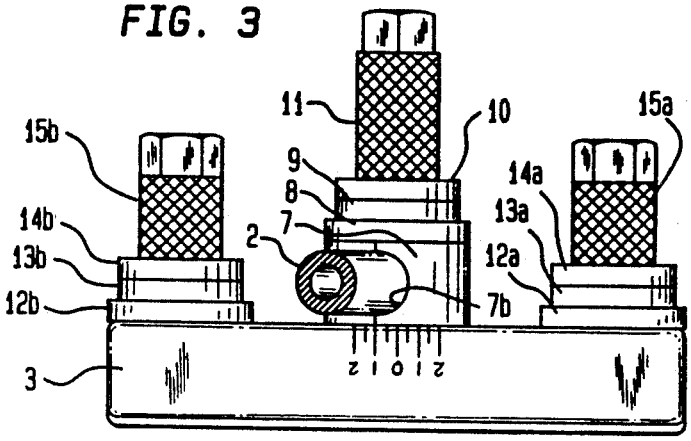
FIG. 3 is a side elevational showing of the putter head of FIG. 2.
Figure 5:
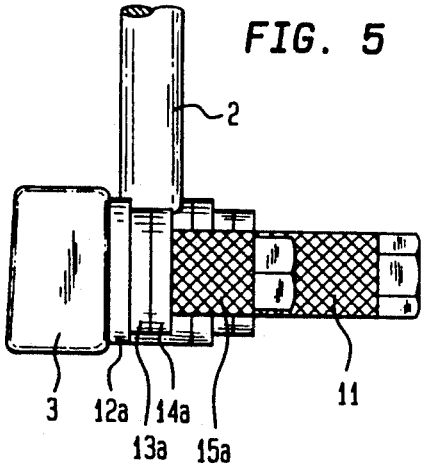
FIG. 5 is an end-elevational showing of the putter head of FIG. 4 .
Figure 4:
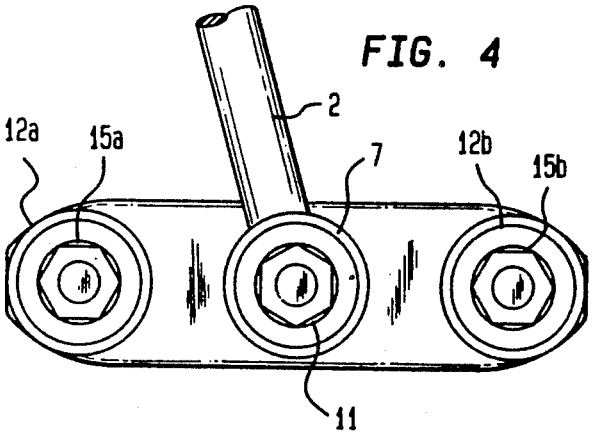
FIG. 4 is a plan view of the putter head of FIGS. 1-3 showing the adjustable connection to the shaft.
Figure 6:
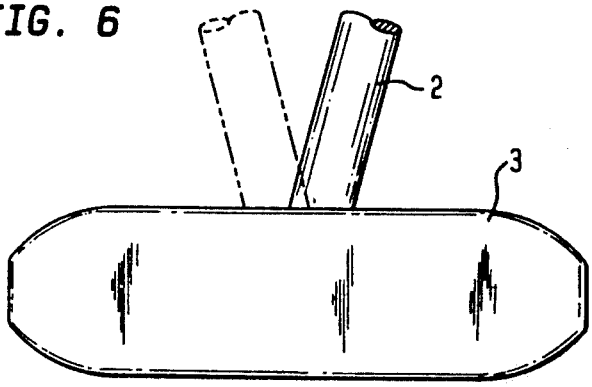
FIG. 6 is a view of the ball impacting surface of the putter head of FIGS. 1-5 showing the shaft in reverse positions.

FIG. 2 shows an enlarged perspective of the head 3 with the shaft removed from the hub 7, partly disassembled. It will be understood that the elements in the process of being mounted on the screw post 4*a* are substantially similar to the elements mounted on screw post 4*b* (not shown), and correspondingly numbered.

In accordance with the present invention, the center of gravity of the putter head 2 may be varied according to any desired arrangement of weights on the posts 4*a*, 5 and 5*b*. In the present embodiment, the weights 8, 9 and 10, 12*a*, 12*b*; 13*a*, 13*b*, and 14*a*, 14*b* are each in the form of an annular washer of heavy metal, such as stainless steel, $\frac{1}{8}$ inch thick, and having a central bore just exceeding $\frac{1}{4}$ inch in diameter, which is designed to be accommodated by a respective one of the screw-threaded posts 5 or 4*a*, 4*b*. The larger weights 8 , 12*a*, and 12*b* are 15/16 inch in diameter and the smaller weights 9, 10; and 13*a*, 13*b*, 14*a*, 14*b* are $\frac{3}{4}$ inch in diameter. The small washers weigh, for example, about $\frac{1}{4}$ ounce each, whereas the larger washers weigh slightly more, say $\frac{1}{3}$ ounce each. It will be understood that the shape , material, number and weight of the individual weights 8, 9, 10, 12*a*, 12*b*, 13*a*, 13*b* and 14*a*, 14*b*, is not limited to those shown herein by way of example, but may be varied according to any pattern desired by the user.

In the presently described embodiment, after the hub 7 has been interposed on the central opening 7*a* and set in place on the surface of the core body 3, the washers 8, 9 and 10, in any combination desired, are interposed onto post 5 in contiguous relation.

The annular nut 11, is $\frac{1}{2}$ inch out diameter, and has an internal screw-threaded bore $\frac{1}{4}$ inch in diameter which is designed to mate with the screw-threaded post 15. Nut 11, weighs, say $\frac{3}{4}$ ounce, is one inch in axial length, on its lateral curved sides, and terminates at its upper end $\frac{1}{4}$ inch from the top, in a hex shape with flat faces, to enable nut 11 to be tightened into place with fingers or a wrench. The nuts 15*a* and 15*b* are similar, except that they are smaller, say $\frac{3}{4}$ inch long and weighing, say, $\frac{1}{2}$ ounce, each.

These elements may be threaded together in any desired combination, at the option of the user. For example, all or less than all of the washers 8, 9 and 10 may be interposed on to the post 5, and the nut 11 then tightened in place to hold all of the elements in secured, contiguous relation. The hub 7, to which the shaft 2 has been secured in the opening 7*b*, may be rotated to any desired angular position on the outer surface of body 3, and tightened in place by the nut 11.

Likewise all, or less than all, of the washers 12*a*, 12*b*, 13*a*, 13*b* and 14*a*, 14*b* may be interposed onto the posts 4*a* and 4*b* and tightened into contiguous relation on their respective posts by the nuts 15*a*, 15*b*.

A principal advantage of the invention is that the elements of the head may be changed and tightened on the golf-course, using the fingers, or a simple wrench, allowing the user to change the angle of the shaft, or the center of gravity of the head to suit his or her needs during play.

As an additional feature, calibration marks are engraved on the surf ace of the lower lateral surf ace of the hub and on the matching surface of the core body to indicate the angular setting of the hub.

It will be apparent that various modifications of the arrangements of the posts 5 and 4*a*, 4*b* may be employed on the surface of the body 3. For example, one or more of the posts 5, 4*a*, and 4*b* may be eliminated from the outer surface of 3, or they may point in a different direction from the outer surface.

It will be understood that the present invention is not limited to devices of the specific form, weight, shape or material shown and described by way of example, but only by the recitations of the appended claims.

What we claim is:

1. A golf putter head comprising in combination:

an elongated metal body portion having a substantially flat ball contacting surface and a second surface substantially coextensive with said ball contacting surface, said second surface including a central portion and a pair of lateral end portions on either side of said central portion parallel to said ball contacting surface;

a plurality of screw-threaded posts fixedly attached to and protruding outwardly in substantially normal relation to said second surface in a direction pointed away from said ball contacting surface;

said plurality of screw-threaded posts comprising three screw threaded posts including a central post disposed at the center of said second surface and a pair of lateral posts respectively adjacent the lateral end portions of said second surface;

means for detachably securing a plurality of annular washers in external relation to said posts for changing the location of the center of gravity of said putter head wherein said plurality of annular washers are interchangeably interposable onto or detachable from each of said posts in accordance with a preselected pattern; and said means for securing said annular washers on said posts including a plurality of screw-threaded nuts, one for respectively securing said washers in place on each of said posts.

2. A golf putter head comprising:

a head comprising an elongated metal body portion having a substantially flat ball-contacting surface and a second surface substantially parallel to said ball-contacting surface, said second surface including a central potion and a pair of lateral end portions on either side of said central portion;

a central metal post fixed to and protruding outwardly in substantially normal relation from the central portion of said second surface in a direction pointed away from said ball-contacting surface;

a pair of metal posts fixed to and protruding outwardly from symmetrical positions from respective lateral end portions of said second surface in a direction substantially parallel to said central metal post; said central post and said pair of posts being screw-threaded;

weights comprising a plurality of annular metal washers constructed to be interposed in interchangeable relation on said posts for varying the location of the center of gravity of said head in accordance with a preselected pattern;

means including a plurality of screw-threaded nuts for securing said hub and said washers in locked position on said respective posts;

an annular cylindrical hub having a central bore constructed and arranged to be accommodated in axial relation on said central post, contiguous with said second surface and to be rotatable to different positions about said axis with reference to said second surface;

means for securing said hub in a preselected one of said axial positions on said post;

a shaft having a hand grip on one end and a terminal portion opposite said hand grip; and means for securing the terminal portions of said shaft to the cylindrical wall of said hub in radial relation to said hub, wherein the terminal portion of said shaft is secured to said hub and said hub is secured on said post; said shaft being constructed to be locked at a preselected axial position relative to said head.

* * * * *